US006050844A

United States Patent [19]

Johnson

[11] Patent Number: 6,050,844

[45] Date of Patent: Apr. 18, 2000

[54] ELECTRICAL CONNECTOR WITH CHANNELS FOR WIRES

[76] Inventor: Dee Lynn Johnson, 7049 Victoria Rd., St. Paul, Minn. 55125-4020

[21] Appl. No.: 09/064,463

[22] Filed: Apr. 29, 1998

[51] Int. Cl.[7] ..... H01R 4/24

[52] U.S. Cl. ..... 439/415

[58] Field of Search ..... 439/415, 429

[56] References Cited

U.S. PATENT DOCUMENTS

| | | | |
|---|---|---|---|
| 3,156,762 | 11/1964 | Matthysse | 439/415 |
| 3,579,172 | 5/1971 | Clark | 439/415 |
| 3,710,305 | 1/1973 | Clark | 439/415 |
| 3,826,861 | 7/1974 | Karl et al. | 174/84 |
| 3,875,324 | 4/1975 | Waddington et al. | 174/87 |
| 3,902,780 | 9/1975 | Dola | 339/97 |
| 4,025,152 | 5/1977 | Jacobsen | 339/246 |
| 4,108,524 | 8/1978 | Seligman | 339/47 |
| 4,194,256 | 3/1980 | Knickerbocker | 7/107 |
| 4,210,378 | 7/1980 | Baribeau | 339/97 |
| 4,279,460 | 7/1981 | Forberg | 339/97 |
| 4,422,701 | 12/1983 | Anderson | 439/107 |
| 4,541,680 | 9/1985 | Johnston | 439/415 |
| 5,306,170 | 4/1994 | Luu | 439/100 |
| 5,525,080 | 6/1996 | Calder et al. | 439/709 |
| 5,630,735 | 5/1997 | Eckert | 439/721 |

*Primary Examiner*—Neil Abrahms
*Assistant Examiner*—Javaid Nasri
*Attorney, Agent, or Firm*—Schwegman, Lundberg, Woessner and Kluth

[57] ABSTRACT

An electrical connector is provided which has an insulating body with at least two open areas which may contain electrical conductors, such as insulated wires inserted into the open areas. The at least two open areas are positioned within the insulating body to support the electrical conductors in proximity. A connector bore is provided towards at least one area where the electrical conductors are in proximity. An electrically conductive element having conductive threads which are capable of cutting into and through insulation on wires is directed into the connector bore. The electrically conductive element with threads (or other screw-like, bolt-like or parallel edges extending from the sides of the electrically conductive element) is rotated within the connector bore so that the thread elements cut through the insulation (eventually or simultaneously of both wires) within at least one area where the conductors are in proximity. The electrically conductive element thereby establishes electrical contact between the wires. A cap or flap may be installed to cover the electrically conductive element to prevent collateral or external contact with the connected electrical wires.

11 Claims, 6 Drawing Sheets

ELECTRICAL CONNECTOR WITH CHANNELS FOR WIRES

BACKGROUND OF THE INVENTION

1. Field of the Invention

The present invention relates to electrical connectors, such as those used for connecting electrical wires. The invention more particularly relates to an electrical connector for electrically connecting two insulated wires with a simple, inexpensive, fast-acting mechanical connector.

2. Background of the Art

U.S. Pat. No. 3,875,324 shows one of the earlier wire connectors in which installation is effected by rotating a pair of wires within a conically shaped bore with threads within the bore which force electrical connectors into engagement. Installation torque is transmitted from an insulated housing to a tapered spring connector member contained within a cavity in the housing through threaded engagement between a convolution at the smaller end of the spring member and the housing.

U.S. Pat. No. 5,630,735 describes an electrical connector comprising a plastic, non-conducting block encasing an electrically conductive bus exchange comprising a conductive metal sheet with at least one rolled, hollow portion for receiving and electrically coupling a pair of electrical conductors. The rolled portion includes two crimps disposed approximately at the center of the rolled portion in mirror opposition which serve as contact stops for the electrical connectors. The block may include longitudinal bores for receiving the electrical wire to be connected. Insulated screws are inserted into transverse bores in the block, which transverse bores intersect the longitudinal bores. The screws, preferably formed of an insulating material such as nylon, abut the insulated portions of the electrical wires within said block to hold the wires in places.

U.S. Pat. No. 3,826,861 describes an electrical connector which operates in conjunction with a crimping device which closes and forms the connector about and into electrical contact with the electrical conductors, e.g., insulated wires. Electrical contact elements (4*a*) are shown which are sharp edged features which puncture the insulation as the sharp edged features are forced into contact with the electrical conductors during crimping of he electrical connector.

U.S. Pat. No. 4,210,378 describes an electrical wire connection in which a wire is force into electrical contact within an insulating connector body. An insulated electrical wire is inserted into wire connecting slots, with one wire being inserted deeper than another wire. The insulation is cut by the slots and the wires are deeply inserted into the slots. A screw is used to advance the connecting element, with the slots providing the electrical contact between conductors.

U.S. Pat. No. 3,902,780 provides an electrical connector in which two separate bores are provided within an insulating body. Separate wires are fed into each of the bores, plug members (e.g., bolts) are provided for each bore, and wire receiving passageways are provided into each bore. The plugs are tightened about insulated wires within the bores, and the insulation is deformed from around the insulated wires to create electrical contact between the bores and the electrical conductors (wires). An electrical connection between the two plugs establishes electrical contact between the two wires.

A commercial electrical conductor, for which no specific published reference material is know comprises a guillotine connector. Two parallel bores within an insulating body are provided. A metal piece which may be forced in a direction perpendicular to the two parallel bores is slidably held within the insulating body. A flip cap is molded onto the side of the insulating body adjacent the guillotine connector. When the two wires are slid into the bores, the guillotine connector, with a separate opening for each wire which lies within the separate bores, is forced into the bores. The separate openings for the wires has metal edges which slice through the insulation on the wires. As the guillotine connector make contact with each wire within each bore, their is an electrical connection established through the guillotine connector. The flap is then snapped over the insulating body to insulate the guillotine connector from live contact.

Many other electrical connectors or devices which establish electrical contact between wires or elements use screws or bolts to secure contacts into place, force electrical contact through insulation, and make electrical connections. For example, see U.S. Pat. Nos. 4,025,152; 4,108,524; 4,194,256; 5,306,170; and 5,525,080.

There still exists a need for alternative electrical connecting devices which can provide a quick connection between electrical conductors and may use at least some staple items of commerce rather than specialty molded parts to provide the device.

SUMMARY OF THE INVENTION

An electrical connector is provided which has an insulating body with at least two open areas which may contain electrical conductors, such as insulated wires inserted into the open areas. The at least two open areas are positioned within the insulating body to support the electrical conductors in proximity. A connector bore is provided towards at least one area where the electrical conductors are in proximity. An electrically conductive element having conductive threads which are capable of cutting into and through insulation on wires is directed into the connector bore. The electrically conductive element with threads (or other screw-like, bolt-like or parallel edges extending from the sides of the electrically conductive element) is rotated within the connector bore so that the thread elements cut through the insulation (eventually or simultaneously of both wires) within at least one area where the conductors are in proximity. The electrically conductive element thereby establishes electrical contact between the wires. A cap or flap may be installed to cover the electrically conductive element to prevent collateral or external contact with the connected electrical wires.

DETAILED DESCRIPTION OF THE INVENTION

Figure 2:
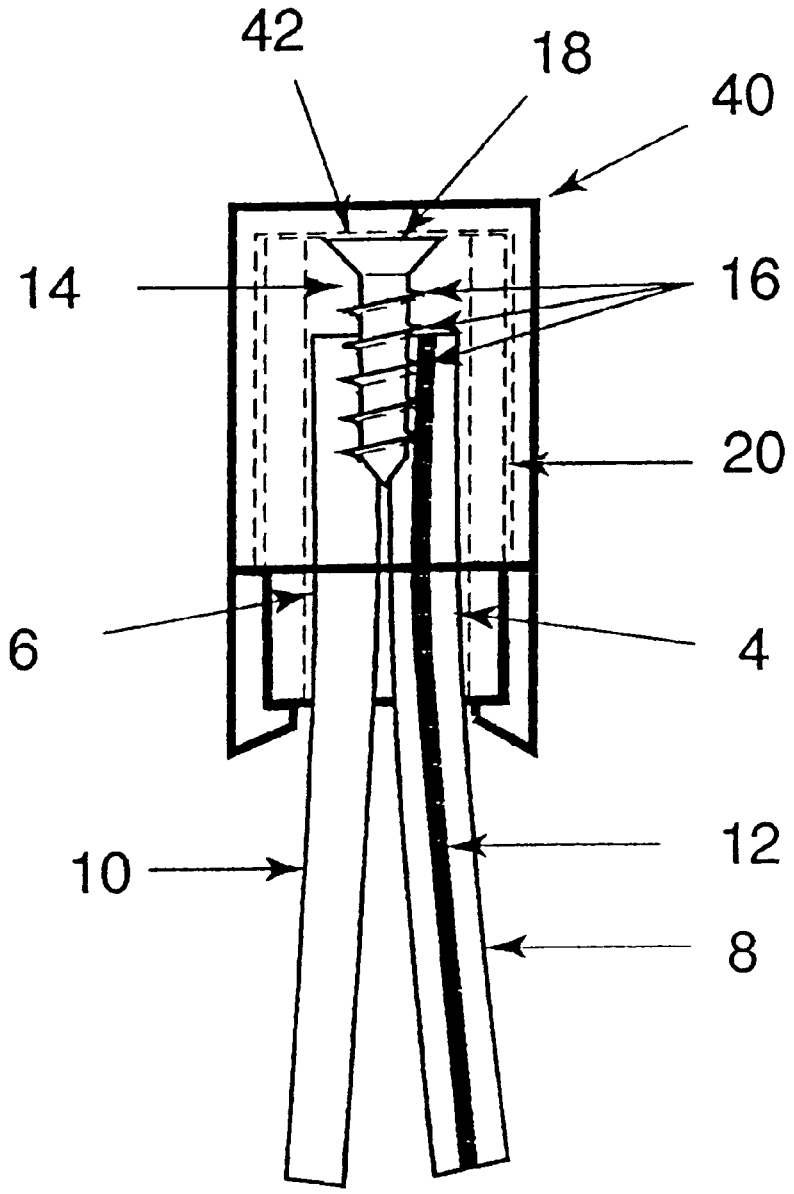
FIG. 2 shows an assembled electrical connector with cap according to the present invention.

The present invention describes an electrical connector 40 as shown in FIG. 2, especially an electrical connector for providing electrical contact between at least two insulated wires. The electrical connector device of the invention comprises at least two elements, an insulated connector body and a conductive element with insulation-penetrating threads or edges, hereinafter referred to as a threaded conductor element. Additional beneficial features may also be provided.

Figure 1:
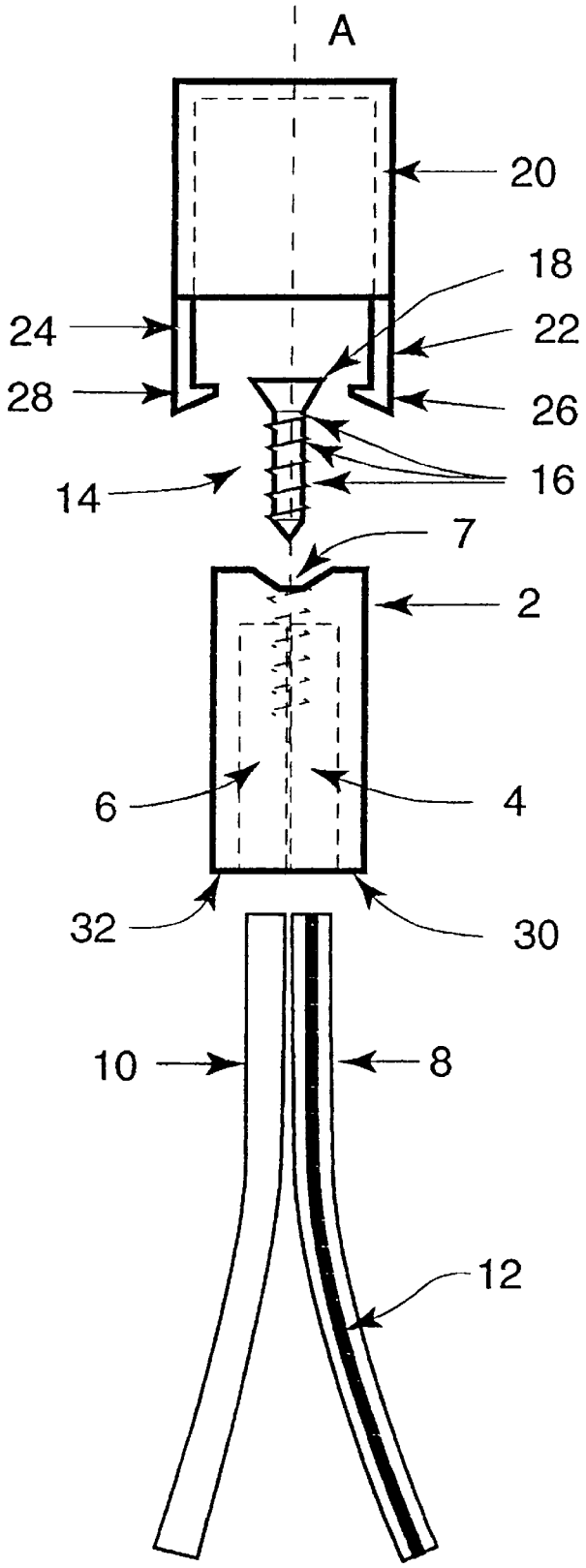
FIG. 1 shows an unassembled electrical connector with cap according to the present invention.

The insulating body 2 in FIG. 1 may comprise any solid insulating material, such as polymeric materials, composite materials, natural materials and the like. For example, the insulating body may comprise polymeric materials of any of the insulating types, such as for example, vinyl resins (e.g., vinyl chloride, vinyl acetate, polyvinyl acetals, etc.), polyesters (e.g., polyethyleneterephthalate), polyamide resins (e.g., nylons such as nylon-6,6), polyacrylic resins (e.g., polyacrylates, polymethacrylates), polyolefins (e.g., polyethylene, polypropylene, etc.), polystyrene resins, polyurethane resins, polysilicone resins (e.g., polysiloxanes), polyimide resins, phenolic resins, epoxy resins, and the like, including copolymers and blends of these types of polymeric materials. Composite materials which are electrically insulating may also be used. These may include mixtures of polymers (natural and synthetic), natural and synthetic resins, minerals (asbestos, clays, inorganic materials, cellulosic fibers, both natural and enhanced [e.g., cellulose acetate, exploded fibers, micro fibers, etc.]), crystalline materials and amorphous materials. The main requirement is that the composition be insulating and that it have structural integrity. It should be formable by at least one convention means, such as molding, extrusion, carving, drilling, or the like. Moldable or extrudable materials, and especially polymers and composite materials are preferred.

The threaded conductor element 14 in FIG. 1 comprises an elongate element having at least one portion thereof which is conductive between two sections of the threaded conductor element. The simplest design is where the entire threaded conductor element is conductive, as with a metal screw. However, the basic principles of the invention could be practice if an insulating plastic screw were provided and a conductive coating were deposited on the threads or a portion of the threads to allow electrical transmission from one area of the threads to another. It is preferred, primarily from an economic perspective to use commercially available standard screws or bolts for practice of the present invention. It is most preferred to use standard screws with the edges of the threads 16 providing a sharp edge feature which can easily penetrate the insulation around an electrical wire 12 when the thread is rotated against the wire 12 under pressure. It is not even essential to the practice of the present invention that the threads have a dimension which is greater in length than the thickness of the insulation around the wire, although this is preferred. Because of the pressure applied by the threads through the insulation, the insulation surrounding the cut or penetration by the screw thread is compressed, allowing the edge of the thread to make electrical contact with the wire. The use of longer threads (with respect to the thickness of the insulation) allows more assurance that electrical contact will be easily made, although it may allow severing of the wire if too much force is applied.

The insulating housing (the combination of 2 and 20) of the electrical connector of the present invention may, as previously noted, be formed by any forming process, especially extrusion and molding. The body of the housing provides at least two compartments 4 and 6 (chambers, bores, tunnels, channels, holes, or the like) which are either fully enclosing or partially enclosing to support and/or guide electrically insulating wires in proximity to each other. Proximity means that the two wires 4 and 6 will be sufficiently near each other in at least one area so that the cross-section of a threaded conductor element 14 (as measured from one outer edge of a thread across the diameter to another outer edge of a thread) will be able to bridge the distance between the wires within the insulation. Preferably, the proximity of the wires 12 within the insulation will be within 99%, preferably within 95%, and more preferably within 90% of the diameter of the cross-section of the threads of the threaded conductor element. In most cases, the proximity of the wires will be within 70% or within 50% or even with 30% or less of the diameter of the cross-section of the threaded conductor element 14.

The walls of the compartments should be able to restrain the movement of the insulated wires so that when forces are transmitted by the rotation of the threaded conductor element to the wires 8 and 10, the wires 8 and 10 are not displaced to a degree that the threads will merely push the insulated wires 8 and 10 without allowing the threads to penetrate the insulated wires 8 and 10. The angle of the threaded conductor element as it approaches the insulated wires in proximity is adjustable, depending on certain desired construction features in the connector device and its use. The most facile angle of approach (the angle of the bore or channel within the housing), when the wires 8 and 10 are parallel to each other, lies within a plain which is perpendicular to the plane which contains both wires 8 and 10. That is, the path of the bore or channel will include the paths of approach perpendicular to the plane including both wires 8 and 10 and the path of approach parallel to and in between the wires 8 and 10 within the plane including the two wires 8 and 10. The threaded conductor element may be rotated at any angle within that plane of approach, or the threaded conductor element may be advanced at an askew angle, as long as the diameter of the cross-section of the threaded conductor element encompasses a space including the volume of at least a portion of the wires 8 and 10 within the insulation. About the only path that would be undesirable is a path which was perpendicular to both wires 8 and 10 and within the plane of both wires 8 and 10. This path would be most likely to sever at least one or both of the wires 8 and 10 rather than merely establishing electrical contact.

The advancement of the threaded conductor element through the connecting bore towards, up to, and partially past (e.g., the point of the threaded conductor element will pass beyond the plane defined by the two insulated wires 8 and 10 or at least the wires within the insulation) the insulated conductor elements causes the edge of the threads of the threaded conductor element to slide across the surface of the insulation and slice into that surface, through the insulating material and into contact with the wires within the insulation. By slicing through the insulation on both insulated wires, electrical contact is established with the two electrical wires through the threaded conductor element.

The surface of the insulating housing may contain a receptive area for the head of the threaded conductor element so that it fits snugly in place below the surface of the insulated housing. This receptive area prevents the head of the threaded conductor element from protruding from the insulating housing. If the head of the threaded conductor element does protrude, a covering cap 20 may be provided (of an insulating material) to prevent the head from electrically contacting another element or device or object. Even if the head 10 of the threaded conductor element does not protrude, but the top lies below the plane of the surface of the insulating body, electrical contact with outside materials would be preferably avoided by the use of a cap 20. The cap 20 could be any structure which blocked access to the head of the threaded conductor element. This could be as simple an arrangement as a plug for the opening or a flat plate which fits onto the surface over the hole. The flat (or curved or otherwise shaped) cover could be secured over the hole by any mechanical securement means such as an adhesive, snap fixture, staple, stitch, engaging track, cam engagement, dog ear interlocks, fusing, clamps, gel, clips or the like.

The present invention also includes electrical connectors which may be used to form plug connectors (as in FIG. 4, 49), as commonly found in wall outlets for receiving electrical plugs from appliances. These may include, for example, an electrical connector for forming an electrical cord outlet comprising:

a) an insulating housing, the housing having at least two compartments 60 and 62 therein for receiving an insulated wire in each compartment, b) each compartment having an insulated wire receiving section with an opening for receiving insulated wire at one end of the housing and an electrical plug receiving section with an opening for receiving an electrical plug at another end of the housing 54, c) the insulated wire receiving section having a screw 70 receiving hole extending into the wire receiving section, d) an element within the housing which provides an electrical connection between a screw within the screw receiving hole and an electrical plug receiving section. This element for providing an electrical connection or electrical contact between the insulated wire, the screw and the electrical plug receiving section needs to be little more than any conductive element which passes from electrical contact with the screw to electrical contact with the plug receiving section. For example, if the screw receiving section 68 and the plug receiving section 62 were shaped from a single piece of electrically conductive metal, the frame of that single piece would make electrical contact with the screw and the plug receiving element, and thereby the frame acts as the element within the housing which provides an electrical connection between a screw within the screw receiving hole and an electrical plug receiving section. The element, if the screw receiving section and the electrical plug receiving section were separated by an insulating break or insulating material could be any element which electrically connects the screw 70 or the screw receiving section with the electrical plug receiving section, such as a wire, a conductive strip, or any other conductive element which passes from the screw or the screw 70 receiving section to the electrical plug receiving section.

This type of electrical connector may have an insulated electrical wire 72 and 82 present within each insulated wire receiving section and a screw within at least one insulated wire receiving section with a insulated wire present therein. Threads on the screw penetrating insulation on the insulated wire present therein make electrical contact between the insulated wire and an electrical plug receiving section. The electrical connector may have at least two insulated wire receiving sections with wires secured therein by screws 70.

Figure 1A:
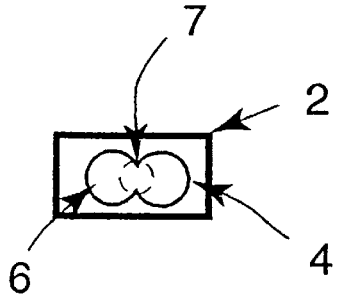
FIG. 1*a* shows a cross-section of the housing of an electrical connector.

These and other aspects of the invention will be readily appreciated by a consideration of the figures. FIG. 1, for example, shows an electrical connector device 2 according to the present invention. The device 2 has two channels or chambers or bores 4 and 6 for receiving insulated wires 8 and 10. Insulated wire 8 is shown in a cutaway view to disclose the wire 12 within the insulated wire 8. FIG. 1*a* shows a cross-section of the electrical connector device 2 with bores 4 and 6 clearly shown. In this particular design, the proximity of the bores 4 and 6 is such that they overlap to assure that electrical contact can be made between any insulated wires within the bores. A clip cap 20 is shown for use with the electrical connector device 2. A pilot hole 7 with side walls 9 is shown for insertion of a screw 14. A screw 14 with sharp edge threads 16 is shown with a pointed end facing the electrical connector device. The axis A of the screw 14 is directed between the bores 4 and 6. This will enable the threads 16, when rotated, to penetrate into the bores 4 and 6, making electrical contact with insulated wires 8 and 10 when 5 inserted within the chambers 4 and 6. The screw 14 is rotated by application of torque against the screw 14 head 18 and advanced into the electrical connector device 2. After the screw 14 has ben inserted, the cap 20 is used to guard against contact with the screw 14 head 18. The cap shown has a preferred securement means comprising arms 22 and 24 having snaps or dog ears 26 and 28 on their ends. The arms are slid along the electrical connector device 2 until the snaps 26 and 28 make engaging contact with the bottom edges 30 and 32 of the electrical connector 2. This cover 20 will be secured to the electrical connector device 2 preventing incidental contact with the head 18 of the screw 14.

FIG. 1*a* shows the cross-section of the housing 2 with the two bores 4 and 6 intersectiong to form a pilot hole 7 for the screw (not shown).

FIG. 2 shows an assembled electrical connector 40 of the invention. The cap 20 is shown locked into place over the electrical connector 2. The insulated electrical wires 8 and 10 are shown inserted within the bores 4 and 6. The cutaway view of insulated wire 8 shows that the wire center 12 is in physical contact with threads 16 of the screw 14. The head 18 of the screw 14 is braced and covered by the underside 42 of the cap 20.

There are numerous benefits which can be practiced with the present invention. The electrical connector of the present invention is reusable. The connector can be rendered waterproof by filling the cap, preferably after insertion of the electrical wires to assure contact of the wires and the piercing element, such as the screw (but also possibly before contact to assure some filling of the volume within the connector).

When the screw is inserted into the connector with the insulated wires present, the screw threads capture the insulation (pulling it tightly into the threads) and the threads anchors themselves (and hence the screw) firmly against the connector. This provides a very strong retention force between the screw, the wires and the housing, so that the wires can not be readily pulled from the connector element. This is a distinct advantage over the connectors where the insulated wires are merely twisted into the connector and the retention forces are much smaller.

Figure 3:
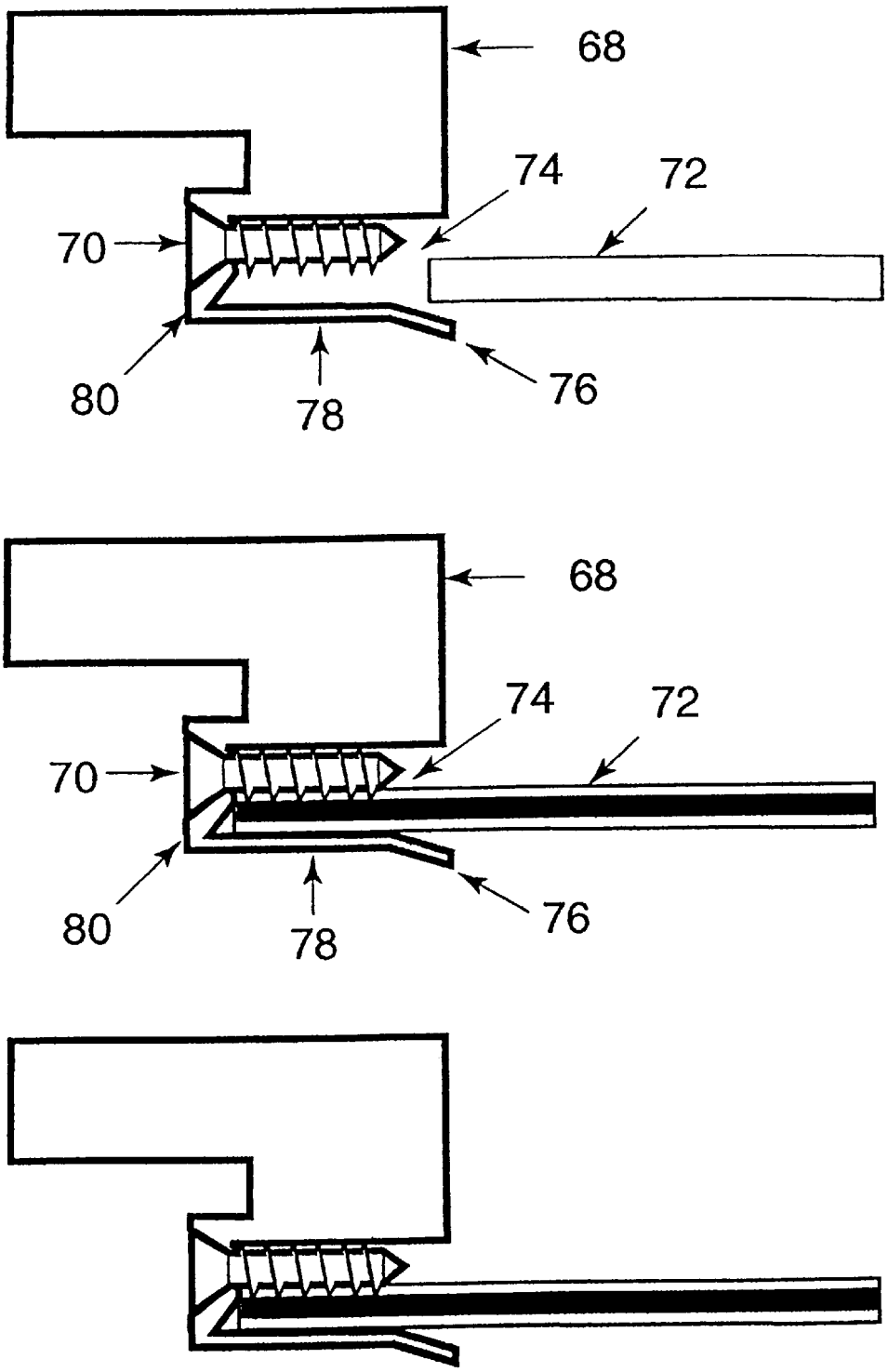
FIG. 3 shows a sectional view of two single wire connectors which may be used in a wall plug outlet connector.
Figure 4:
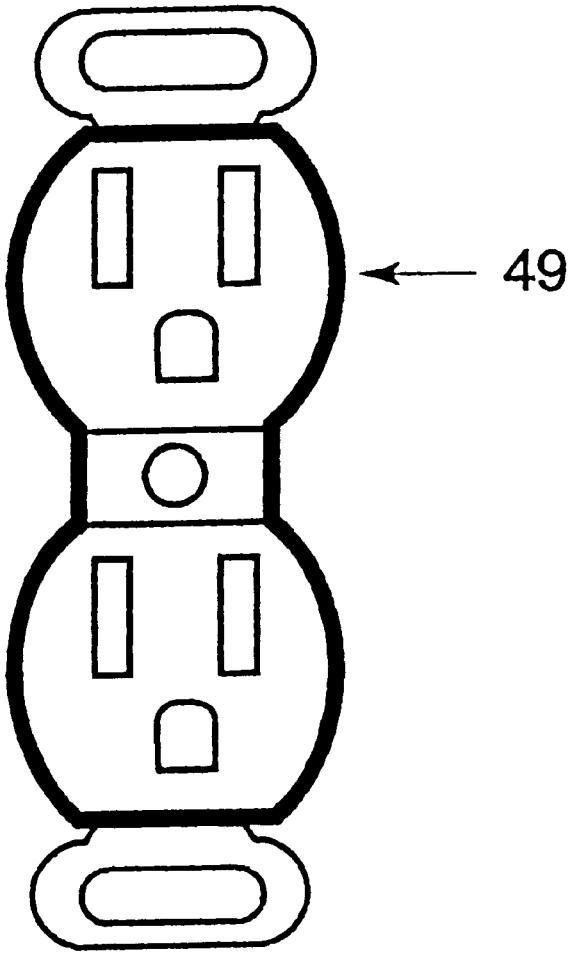
Figure 4 (Prior Art)
FIG. 4 shows a front view of a prior art wall mount plug electrical outlet.
Figure 5:
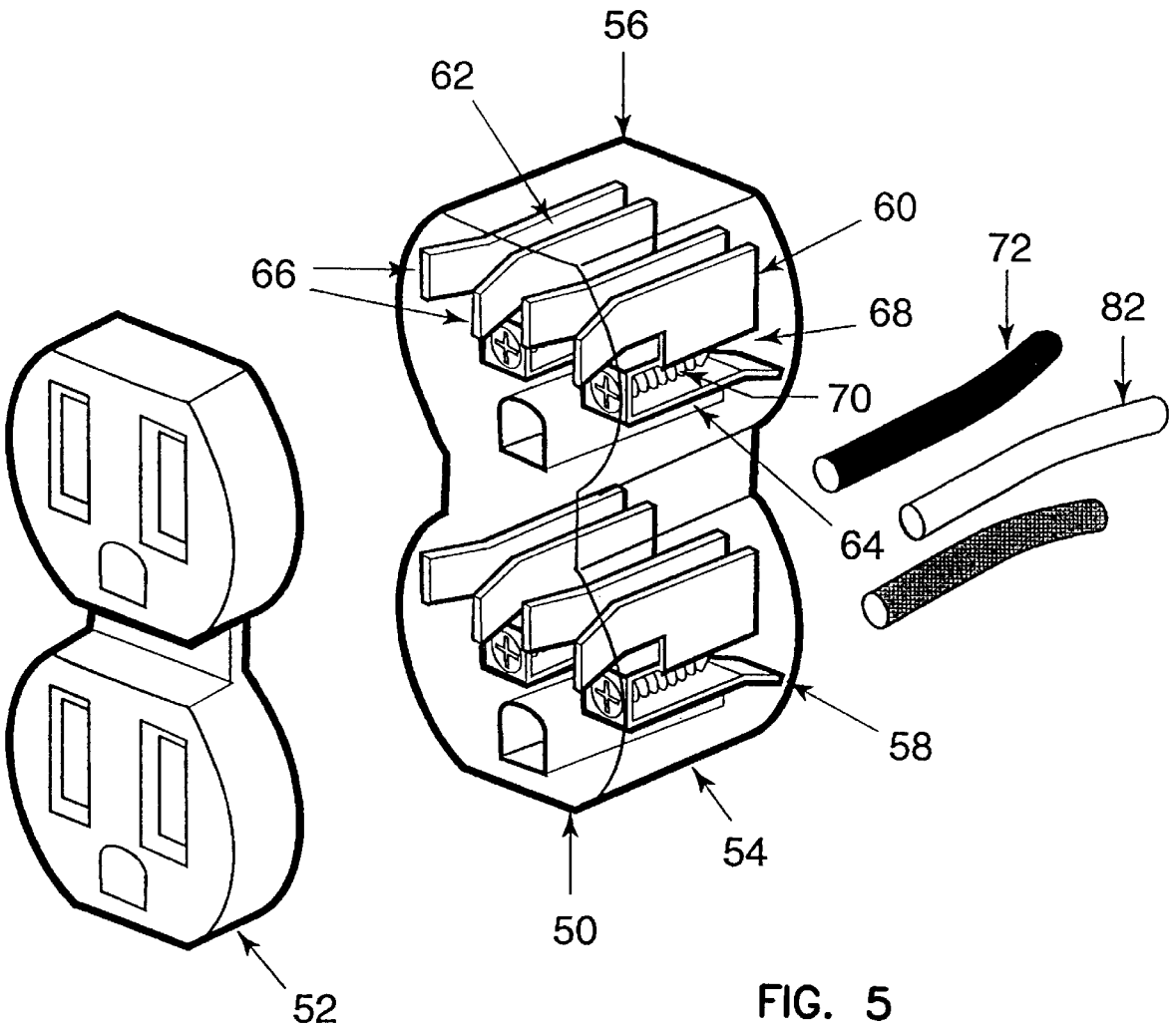
FIG. 5 shows an aspect view of a partially assembled wall mount, electrical plug outlet comprising electrical connectors according to a practice of the present invention.

The present invention may also be used in the connection of wall mounts, extension cord outlets, and extension cords, as well as any other format of electrical connection. For example, a wall mounted extension cord connection or outlet 49 as shown in FIG. 4 can easily be made. In FIG. 5, a typical wall mount connector 50 may comprise two sections, a facing 52 and a housing 54. The housing 54 is shown with two separate connection areas 56 and 58 as is typical within a wall mount fixture. Fourplexes (not shown) could also be constructed, as could any number of connection elements within a housing. Two separate electrical connection modules 60 and 62 are shown, as is a ground element connector 64 in the upper connection element 56. The electrical connection module 60 comprises a pair of forward receiving prongs 66, and the electrical connection module sub-module 68 with a screw 70 therein. The electrical connection module submodule 68 is shown in more detail in FIG. 3. An insulated wire 72 is inserted into the opening 74. A guide slope or lip 76 is shown at the entrance to the opening 74. The screw 70 is shown securely fitted within a screw accepting form, cradle or recess 80 within the submodule 68. It is to be noted that a screw, such as screw 70, does not have to be advanced into the electrical connector, but rather may be seated within the cradle 80 and rotated to pull a wire 72 into the opening 74 to secure retention contact and electrical connection with the wire 72. Electrical contact to a ground wire 82 in the ground element connector 64 may also be effected by a similar mechanism.

Figure 6A:
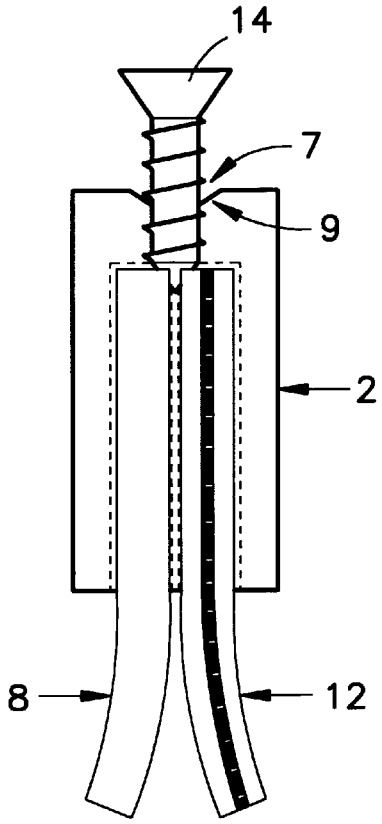
FIGS. 6(*a*) and (*b*) shows cross-sections of electrical connectors with a screw positioned before completion of the connection in 6(*a*) and the screw fully inserted after connection 6(*b*).
Figure 6B:
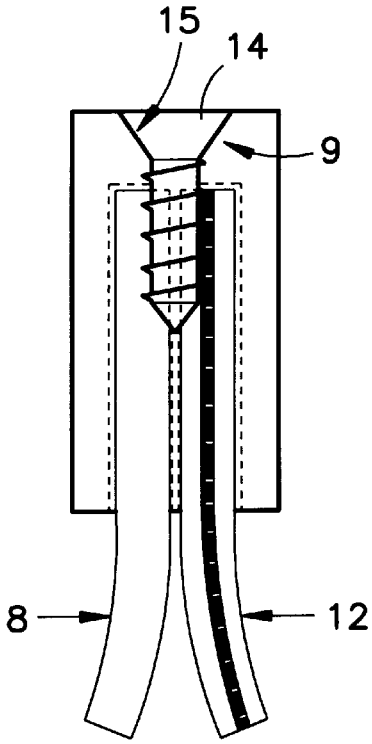

FIG. 6(*a*) shows an electrical connector 2 having a pilot hole 7 with side walls 9 is shown for insertion of a screw 14. As shown in FIG. 6(*b*), after full insertion of the screw 14 into the pilot hole 7, the head 15 of the screw 14 fits snuggly against the side walls 9 of the pilot hole 7.

What is claimed:

1. An electrical connector comprising an insulating housing, said housing having at least two compartments therein which pass within a first distance of each other, within said at least two compartments are insulated wires having wires with an insulating material over them, and between said insulated wires is an electrically conductive element having a multiplicity of raised edges which extend from said electrically conductive element, at least some of the raised edges of said electrically conductive element passing through said insulating material to make electrical contact with said wires with an insulating material over them, said electrically conductive element forming an electrically conductive connection between said at least two wires, said housing having no threads for receipt of said multiplicity of raised edges.

2. The electrical connector of claim 1 wherein said electrically conductive element comprises an elongated element with threads and said housing is a molded polymeric housing with only flat walls therein.

3. The electrical connector of claim 1 wherein said electrically conductive element comprises a screw.

4. The electrical element of claim 3 wherein threads of said screw make contact with at least two wires.

5. The electrical connector of claim 4 wherein said electrically conductive element has a portion which can be contacted in an exposed area without damaging said electrical connector, and a cover is present over said exposed area to reduce the possibility of contact with said electrically conductive element.

6. The electrical connector of claim 1 wherein said electrically conductive element has a portion which can be contacted in an exposed area without damaging said electrical connector, and a cover is present over said exposed area to reduce the possibility of contact with said electrically conductive element.

7. An electrical connector kit comprising an insulating housing having at least two containing bores therein and an entrance bore angled between said at least to containing bores, a conductive screw which can be screwed into said entrance bore, and a cap which can be secured over said entrance bore.

8. The electrical kit of claim 7 wherein said cap is an insulating material and can be secured to said insulating housing by snap connections.

9. A method for electrically connecting two insulated wires comprising steps of inserting at least two insulated electrical wires into an insulating housing, each of said insulated wires comprising a wire conductor and an insulation over said wire conductor, each said insulated wires being separated by a first distance, inserting a screw into said insulated housing, said screw having edges on its threads with a diameter of its cross-section which is greater than said first distance, rotating said screw so that said screw advances into said insulating housing without advancing itself along any threads in said housing for receiving said screw and edges of said threads penetrate said insulation and contact wire conductors in each of said at least two insulated wires.

10. The method of claim 9 wherein after electrical connection has been made between said at least two insulated wires, an insulating cap is placed over a head of said screw.

11. An electrical connector comprising an insulating housing having only flat walls, said housing having at least two compartments therein which can allow insulated electrical wires to pass within a first distance of each other, and between said at least two compartments is an electrically conductive element having a multiplicity of raised edges which extend from said electrically conductive element, at least some of the raised edges of said electrically conductive element passing into both of said compartments to make electrical contact with wires when inserted into said compartments, said electrically conductive element being capable of forming an electrically conductive connection between insulated wires within said at least two compartments.

* * * * *

UNITED STATES PATENT AND TRADEMARK OFFICE

CERTIFICATE OF CORRECTION

PATENT NO. : 6,050,844
DATED : April 18, 2000
INVENTOR(S) : Johnson

It is certified that error appears in the above-identified patent and that said Letters Patent is hereby corrected as shown below:

Title page,
Item [22], in the Filing Date, delete "Apr. 29, 1998" and insert -- Apr. 22, 1998 --, therefore.

Column 7,
Line 50, delete "claim 4" and insert -- claim 1 --, therefore.

Column 8,
Line 5, delete "claim 1" and insert -- claim 4 --, therefore.

Signed and Sealed this

Fourth Day of September, 2001

*Attest:*

Nicholas P. Godici

*Attesting Officer*

NICHOLAS P. GODICI
*Acting Director of the United States Patent and Trademark Office*